United States Patent [19]

Ohira

[11] Patent Number: 5,060,764

[45] Date of Patent: Oct. 29, 1991

[54] VELOCITY CONTROL METHOD FOR ELEVATOR

[75] Inventor: Katsumi Ohira, Inazawa, Japan

[73] Assignee: Mitsubishi Denki Kabushiki Kaisha, Japan

[21] Appl. No.: 481,620

[22] Filed: Feb. 20, 1990

[30] Foreign Application Priority Data

Mar. 17, 1989 [JP] Japan ..... 1-65664

[51] Int. Cl.[5] ..... B66B 1/30

[52] U.S. Cl. ..... 187/116

[58] Field of Search ..... 187/116, 119

[56] References Cited

U.S. PATENT DOCUMENTS

| | | | |
|---|---|---|---|
| 4,354,577 | 10/1982 | Yonemoto | 187/118 |
| 4,576,253 | 3/1986 | Tanahashi et al. | 187/119 |
| 4,611,689 | 9/1986 | Yoshida et al. | 187/119 |
| 4,624,343 | 11/1986 | Tanahashi et al. | 187/119 |
| 4,625,834 | 12/1986 | Tanahashi | 187/119 |
| 4,629,035 | 12/1986 | Tanahashi et al. | 187/119 |
| 4,671,389 | 6/1987 | Tanahashi | 187/119 |
| 4,681,191 | 7/1987 | Ikejima | 187/119 |
| 4,745,991 | 5/1988 | Tanahashi | 187/119 |
| 4,817,761 | 4/1989 | Iwata et al. | 187/116 |

FOREIGN PATENT DOCUMENTS

| | | |
|---|---|---|
| 57-9678 | 1/1982 | Japan . |
| 61-22671 | 6/1986 | Japan . |

*Primary Examiner*—A. D. Pellinen
*Assistant Examiner*—W. E. Duncanson, Jr.
*Attorney, Agent, or Firm*—Leydig, Voit & Mayer

[57] ABSTRACT

A method for controlling the velocity of an elevator cage by determining the optimum time delay between a velocity command signal for an elevator cage and actual movement of the cage responsive to the velocity command signal. The actual time delay is increased or decreased based on a comparison of the actual time needed for the cage to reach its maximum deceleration and the theoretical time needed for the cage to reach its maximum deceleration. The new time delay is introduced into the velocity command signal to thereby control cage velocity.

5 Claims, 6 Drawing Sheets

VELOCITY CONTROL METHOD FOR ELEVATOR

BACKGROUND OF THE INVENTION

This invention relates to a velocity control method for an elevator, and more particularly to a velocity control method in which the delay time of the response of a control system need not be manually adjusted.

FIG. 4 is a schematic constructional view, partly in blocks, showing elevator equipment in which a prior-art elevator velocity control method disclosed in, for example, the official gazette of Japanese Patent Application Publication No. 22671/1986 is performed. Referring to the figure, numeral 1 designates a three-phase A.C. power source, numeral 2 a thyristor converter whose input side is connected to the three-phase A.C. power source 1 and which converts a three-phase alternating current into a direct current, and numeral 3 the armature (the field system being omitted) of a hoisting D.C. motor which is connected to the output side of the thyristor converter 2. Also included in the elevator equipment are the sheave 4 of a hoist, which is coupled to the shaft of the armature 3 and which is driven by this armature 3, a main cable 5 which is wound round the sheave 4, a cage 6 which is joined to one end of the main cable 5, a counterweight 7 which is joined to the other end of the main cable 5, a rope 8 in an endless shape, both the ends of which are spliced to the cage 6, a tightening pulley 9 which is arranged at the lower part of an elevator shaft (not shown) and which applies a tension to the rope 8 wound round it, and a disc 10 which is installed in an elevator machinery room (not shown), round which the rope 8 is wound and which has its circumferential part formed with apertures 10*a* at equal intervals. A pulse generator 11 is arranged in opposition to the circumferential part of the disc 10, and it generates a pulse each time the aperture 10*a* is detected. An add/subtract counter 12 adds the pulses during the ascent of the cage 6 and subtracts them during the descent, thereby to count the current position of the cage 6. The first input converter 13 converts the output of the add/subtract counter 12 into information for an electronic computer. The elevator equipment further includes the central processing unit (hereinafter, abbreviated to "CPU") 14 of the electronic computer, buses 15 such as an address bus and a data bus by which the first input converter 13 and CPU 14 mentioned above and devices to be stated below are interconnected, a read-only memory (hereinafter, abbreviated to "ROM") 16 in which programs for controlling the cage 6, velocity command values corresponding to the variation of a distance, are kept written, and a random access memory (hereinafter, abbreviated to "RAM") 17 which stores data in its storing addresses. Also included are an output converter 18 by which information from the electronic computer is converted into a signal for the elevator device, a tachometer generator 19 which is coupled to the shaft of the armature 3 and which generates a velocity signal corresponding to the velocity of the armature 3 when driven by this armature, and a velocity controller 20 which is connected to the output sides of the output converter 18 and the tachometer generator 19 and which controls the thyristor converter 2 thereby to control the velocity of the hoisting D.C. motor. Numeral 21 indicates call signals which are generated when calls have occurred, and numeral 22 a call registration circuit which registers the calls when supplied with the call signals 21. The second input converter 23 converts the output of the call registration circuit 22 into information for the electronic computer, while the third input converter 24 converts the output of the tachometer generator 19 into information for the electronic computer.

Next, the operation of the elevator equipment shown in FIG. 4 will be described with reference to a flow chart in FIG. 5. Numerals 100–114 in FIG. 5 indicate the operating steps of the elevator equipment in FIG. 4.

At the step 100, the call signal 21 is generated, and the output of the call registration circuit 22 is accepted into the CPU 14 through the second input converter 23. At the step 101, the traveling direction of the cage 6 is discriminated on the basis of the current position thereof, and at the step 102, a start command is given by the CPU 14. At the step 103, the first velocity command value $V_{p1}$ which increases with the lapse of time is generated for a high-speed travel by way of example, and it is transmitted from the ROM 16 to the velocity controller 20 through the output converter 18, whereby the armature 3 of the motor is started. Meanwhile, at the step 104, a deceleration distance (advance magnitude) which is required for the cage 6 to be capable of stopping with a good riding quality is calculated by the CPU 14. Subsequently, the step 105 determines a call, namely, a floor to stop at, which is distant in excess of the advance magnitude.

Now, when the armature 3 is started, the cage 6 begins to move through the sheave 4 as well as the main cable 5. A velocity signal corresponding to the velocity of the armature 3, in other words, the velocity of the cage 6, is issued from the tachometer generator 19. This velocity signal is accepted into the CPU 14 through the third input converter 24 and is differentiated therein, and it is simultaneously compared in the velocity controller 20 with the first velocity command value $V_{p1}$ generated at the step 103, whereby the velocity of the cage 6 is automatically controlled at high precision. Meanwhile, the movement of the cage 6 is transmitted to the disc 10 through the rope 8, and the disc 10 is therefore rotated, whereby the pulse generator 11 generates the pulses. These pulses are added or subtracted by the add/subtract counter 12, and the result is accepted through the first input converter 13 into the CPU 14, in which the current position of the cage 6 is calculated from the movement distance thereof. In consequence, a residual distance S for a point H (shown in FIG. 6 to be referred to later) which indicates the floor scheduled to stop at is calculated by the step 106. The residual distance correction of adding a corrective distance K to the residual distance S is made by the step 107.

Here, the elevator velocity control method in the prior art will be described with reference to FIG. 6. This figure shows a diagram of velocity command value curves in which the response delays of a control system are considered. Referring to the figure, symbol $V_p$ denotes the situation of a velocity command value which changes with the lapse of time during the acceleration of the cage 6, and in which symbol $V_{p1}$ indicates the first velocity command value during the high-speed travel (long-distance travel) of the cage 6, while symbol $V_{p2}$ indicates the first velocity command value during the low-speed travel (short-distance travel). On the other hand, symbol $V_d$ denotes the situation of the second velocity command value which decreases in correspondence with the residual distance S from the current position of the cage 6 to the point H indicative of the floor scheduled to stop at, during the deceleration of the cage 6. In addition, symbol $V_{t1}$ denotes that actual velocity of the cage 6 which delays for a time interval $T_1$ relative to the first velocity command value $V_{p1}$. Likewise, symbol $V_{t2}$ denotes that actual velocity of the cage 6 which delays for the time interval $T_1$ relative to the first velocity command value $V_{p2}$.

In the case where the cage 6 follows up the velocity command value $V_p$ with the predetermined time delay $T_1$, the first velocity command $V_{p1}$ which is advanced for the time interval $T_1$ relative to the cage velocity $V_{t1}$, for example, needs to be delivered as the output of the velocity command value $V_p$ in order that the cage 6 may be run with an aim at the point H indicative of the floor scheduled to stop at. In the high-speed travel mode, the first velocity command value $V_{p1}$ increases from a start point $O_1$ and reaches a point $H_1$ through a point $A_1$ corresponding to a velocity command value $V_{11}$. At the point $H_1$, a change-over preparation command is issued. Meanwhile, the actual velocity $V_{t1}$ of the cage 6 and the second velocity command value $V_d$ are always compared. When the values $V_{t1}$ and $V_d$ become equal at a point $F_1$, the second velocity command value is changed-over from the value $V_d$ to a value $V_{d2}$. As a result, the velocity command value $V_p$ traces a path $O_1$–$A_1$–$H_1$–H. Thus, the velocity of the hoisting D.C. motor, namely, that of the cage 6 is controlled according to this velocity command value $V_p$.

As described before, when the call has occurred during the travel of the cage 6, the residual distance S from the current position of the cage 6 to the scheduled stopping position H is calculated every moment. At a time $B_1$ by way of example, the residual distance S is expressed by the area of a region $B_1$–$C_1$–$F_1$–H–$B_1$. Here, the point $C_1$ corresponds to the value of the actual velocity $V_{t1}$ at the time $B_1$. The corrective distance K is expressed by the area of a region $C_1$–$G_1$–$F_1$–$C_1$. Here, the point $G_1$ corresponds to a velocity command value $V_{13}$. Assuming the waveform of an acceleration as shown in FIG. 7, the corrective distance K is evaluated in accordance with $-a/2\,(2\,T_1^2+2\,T_1\,(2\,T+T_c)+8/3\,T^2+T_c^2+3\,T\,T_c)$. Here, "a" denotes the maximum acceleration, "−a" the maximum deceleration, "T" a jerk time, and "$T_c$" a constant-speed travel time, $T_c \geqq T_1$ being held.

Subsequently, the second velocity command value $V_d$ for the corrected residual distance (S+K) is extracted from within the ROM 16 by the step 108 in FIG. 5. At the time $B_1$, the distance corresponding to (S+K) is expressed by the area of a region $B_1$–$G_1$–$F_1$–H–$B_1$. The extracted second velocity command value $V_d$ and the first velocity command value $V_{p1}$ are compared at the step 109. When $(V_d\text{-}V_{p1}) \leqq$(a prescribed value) at the time $B_1$, the change-over preparation command (a curve $A_1$–$H_1$ in FIG. 6) is issued at the step 110*a*. Besides, at the step 110*b*, the residual distance correction is suspended, and the second velocity command value $V_d$ corresponding to the residual distance S is extracted from the ROM 16, whereupon at the step 110*c*, the second velocity command value $V_{d2}$ delayed for the time interval $T_1$ is obtained by subtracting a $T_1$ from $V_d$. The step 111 compares the first velocity command value $V_{p1}$ and the second velocity command value $V_{d2}$, and when $V_{p1} \geqq V_{d2}$ has held, the step 112 changes-over the first velocity command value $V_{p1}$ to the second velocity command value $V_{d2}$ at the point $H_1$. Thenceforth, the second velocity command value $V_{d2}$ decreases, and the cage 6 is decelerated accordingly. When the completion of the floor arrival of the cage 6 is acknowledged at the step 113, the cage 6 is stopped at the step 114.

The low-speed travel mode proceeds similarly. The second velocity command value $V_d$ for the corrected residual distance (S+K) is extracted from within the ROM 16. The extracted second velocity command value $V_d$ and the first velocity command value $V_{p2}$ are compared, and when $(V_d - V_{p2}) \leqq$(a prescribed value) has held, a change-over preparation command is issued. At a point $H_2$ at which $V_{p2} \geqq V_{d2}$ holds, the first velocity command value $V_{p2}$ is changed-over to the second velocity command value $V_{d2}$.

With the prior-art elevator velocity control, even in a case where the delay time is varied by a rotary switch or the like for adjusting the riding quality of the cage, there is the problem that the adjustments are difficult and require a skilled technique. Moreover, since the respective cages exhibit different delay times, the adjustments for the individual cages are troublesome. Besides, since the delay time varies depending upon the conditions of the respective travels, the riding quality worsens in any travel when the delay time is fixed.

SUMMARY OF THE INVENTION

This invention has been made in order to solve the problems as mentioned above, and has for its object to provide an elevator velocity control method which dispenses with the manual adjustments of a delay time.

The velocity control method for an elevator according to this invention provides that while the velocity command signal is varied by an electronic computer the delay time between the response of a control system and the actual movement of a cage responsive to a velocity command value from an electronic computer is found so as to render the deceleration of the cage favorable; whereupon a velocity command value preceding the delay time is output from the electronic computer.

In this invention, under any of traveling conditions, the delay time for attaining the favorable riding quality has its optimum value found while the velocity command signal is varied by the electronic computer.

BRIEF DESCRIPTION OF THE DRAWINGS

Throughout the drawings, the same symbols indicate identical or equivalent portions.

DESCRIPTION OF THE PREFERRED EMBODIMENTS

Now, embodiments of this invention will be described with reference to the accompanying drawings.

Figure 1:
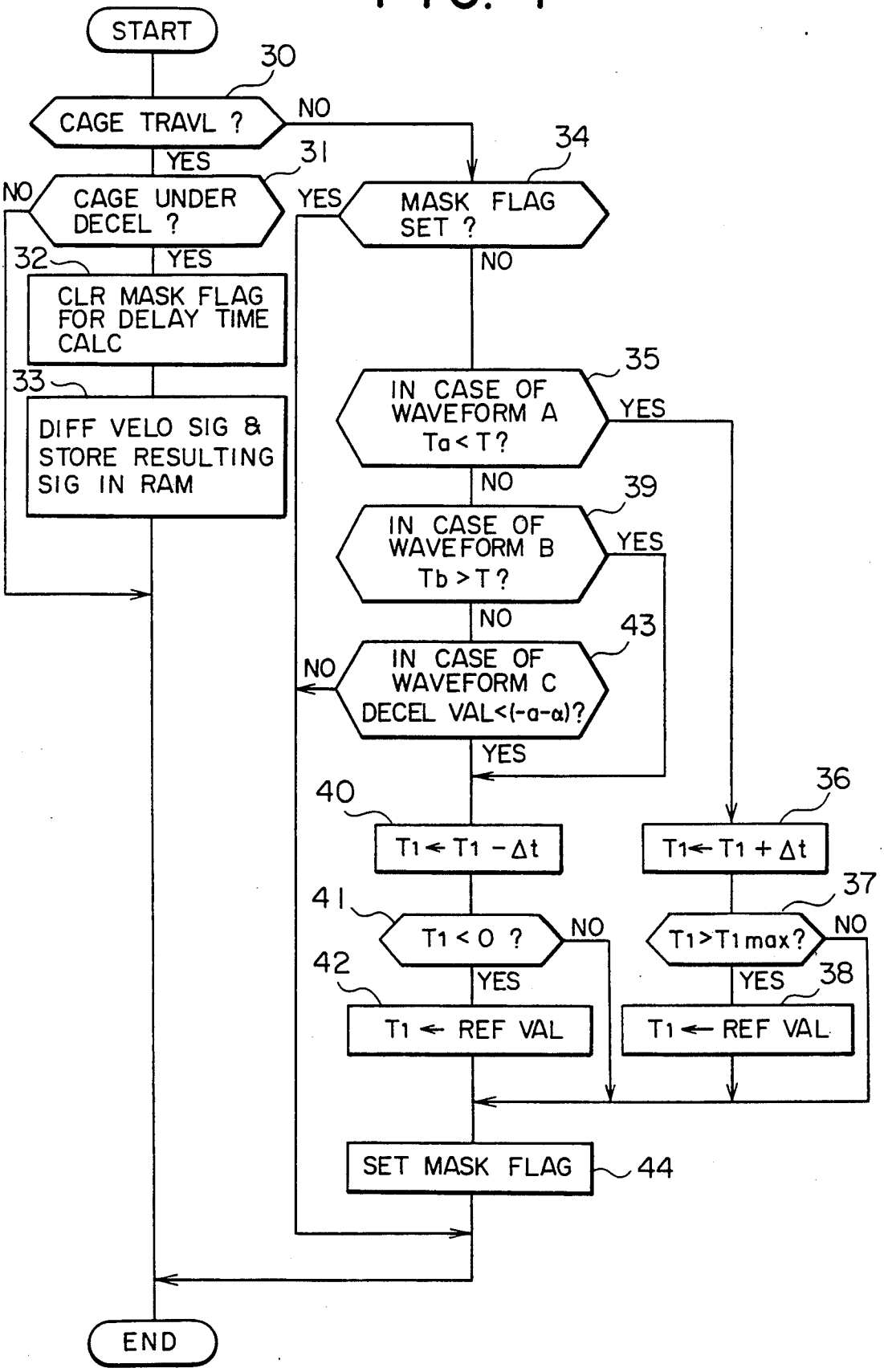
FIGS. 1 and 2 are flow charts for explaining respective embodiments of this invention.
Figure 2:
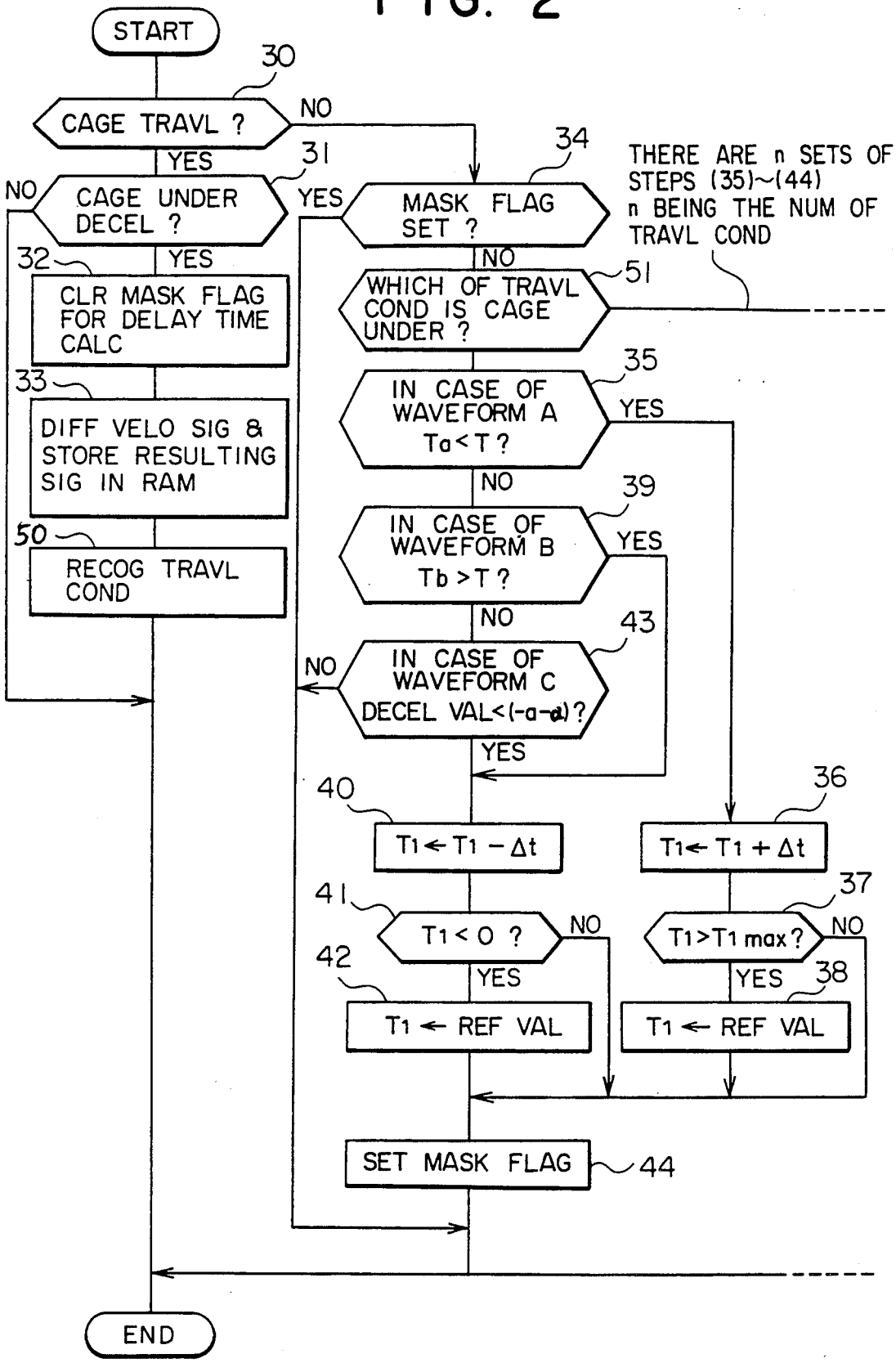
Figure 3:
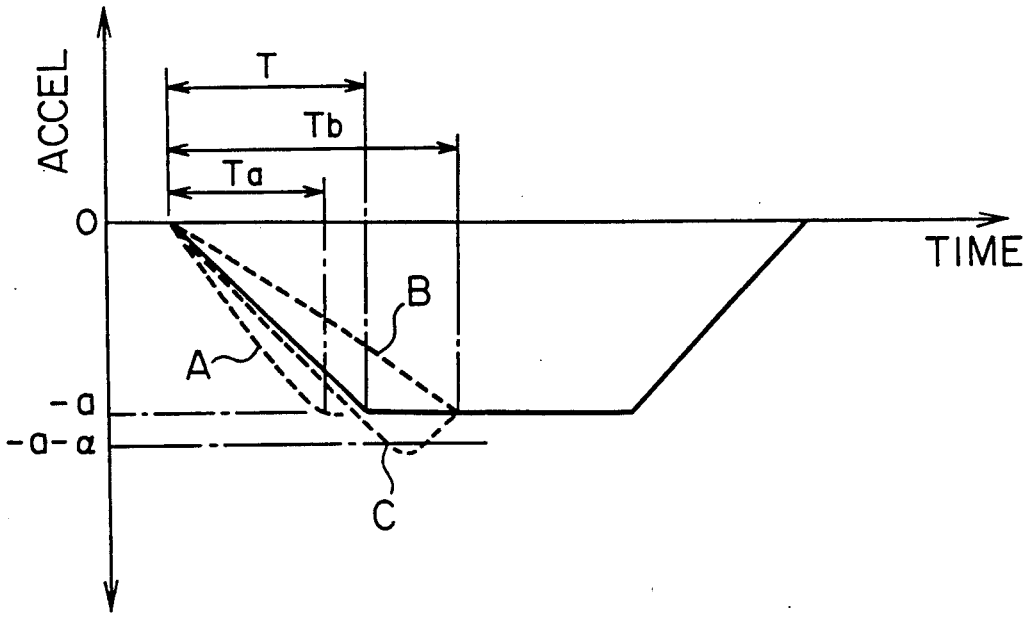
FIG. 3 is a diagram of elevator deceleration curves for explaining this invention.
Figure 4:
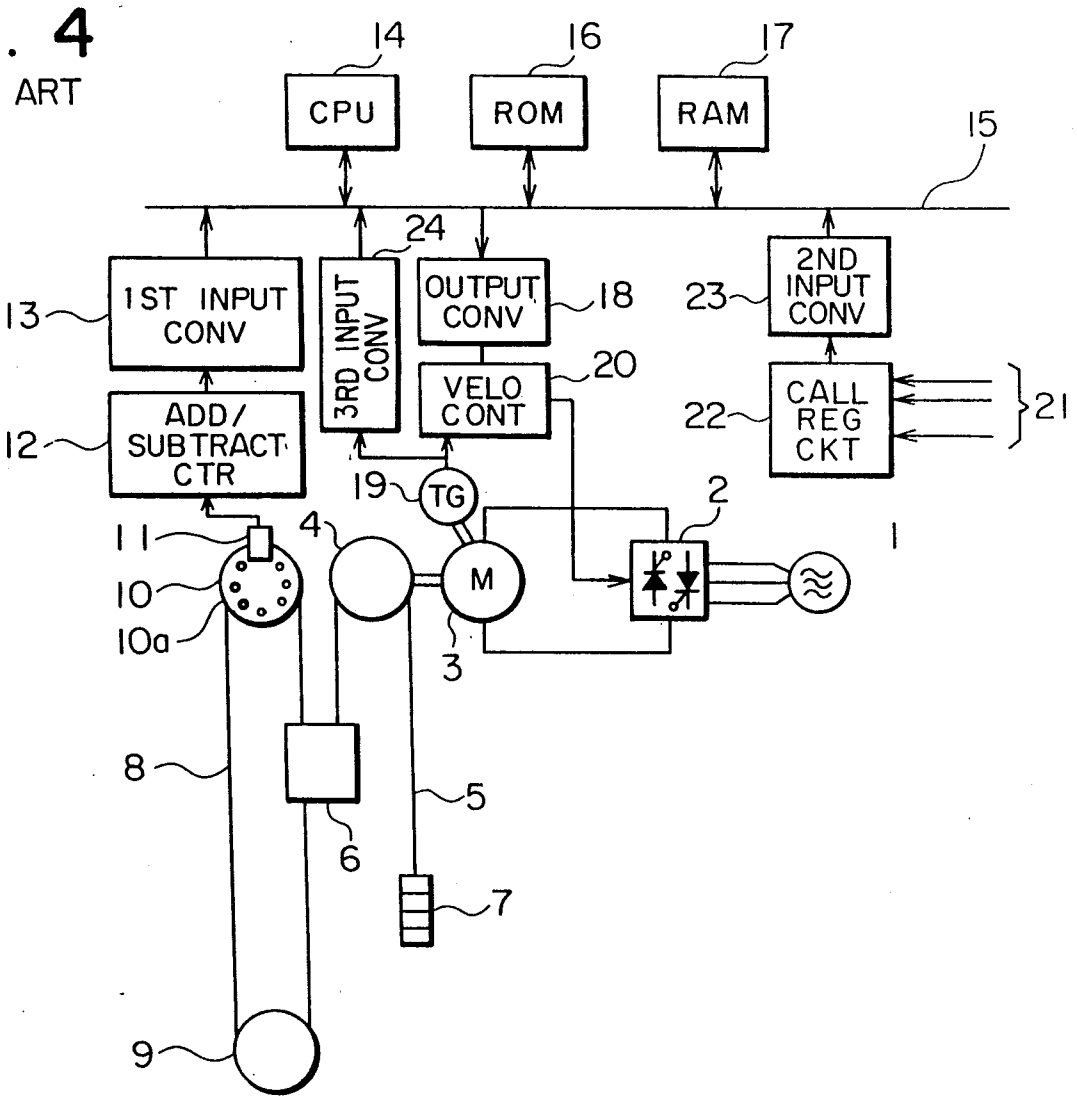
FIG. 4 PRIOR ART
FIG. 4 is a schematic constructional view, partly in blocks, showing an elevator equipment in which an elevator velocity control method in the prior art is performed.
Figure 5:
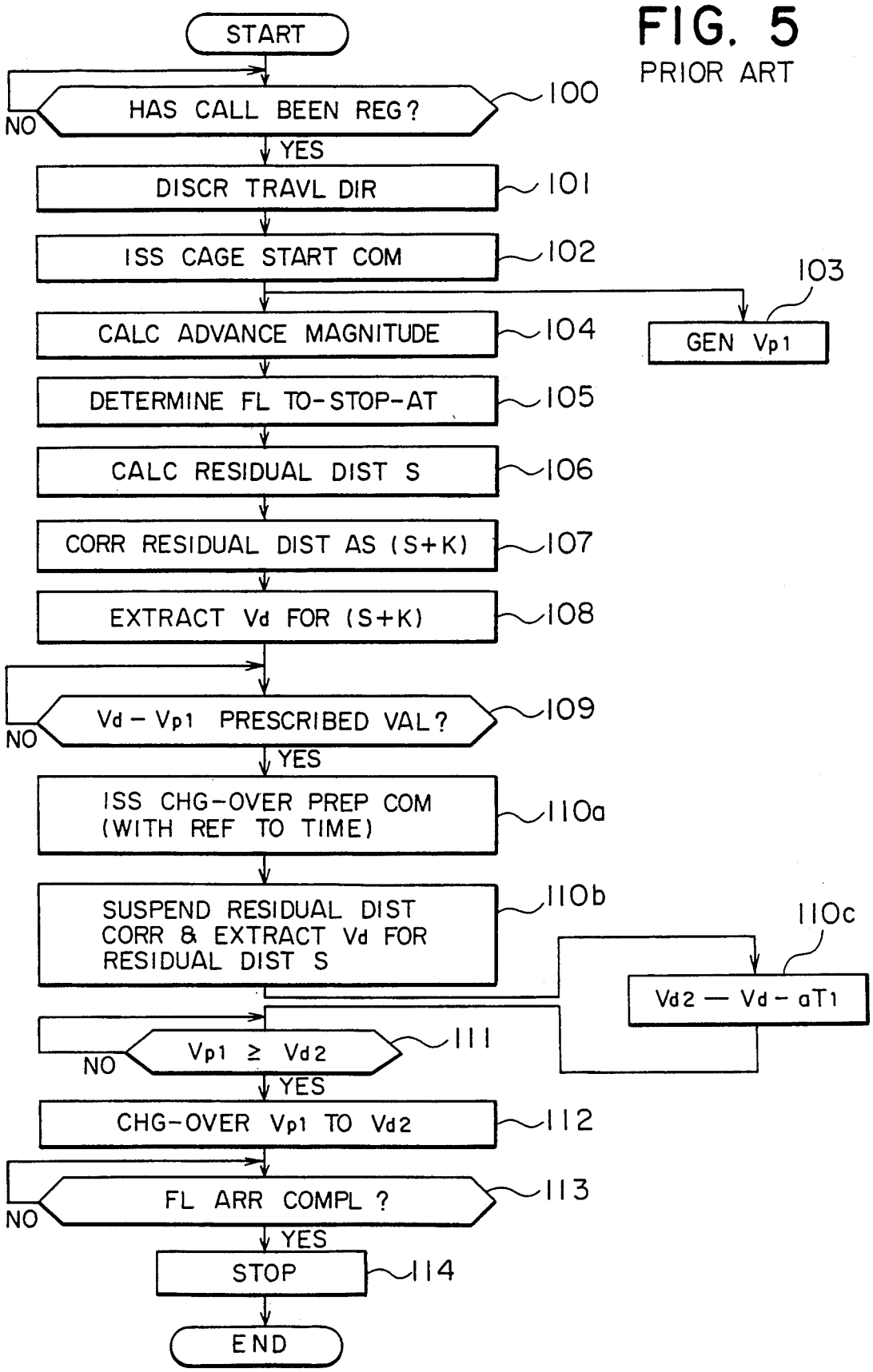
FIG. 5 PRIOR ART
FIG. 5 is a flow chart for explaining the operation of the elevator equipment shown in FIG. 4.
Figure 6:
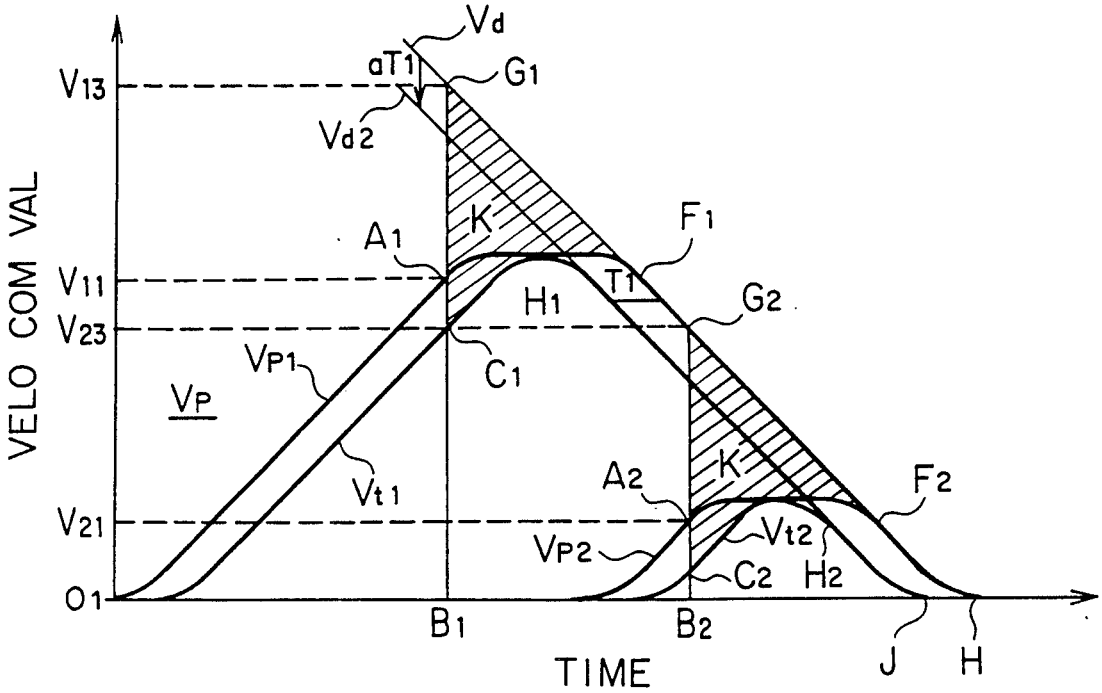
FIG. 6 PRIOR ART
FIG. 6 is a diagram of velocity command value curves for explaining the prior-art method.
Figure 7:
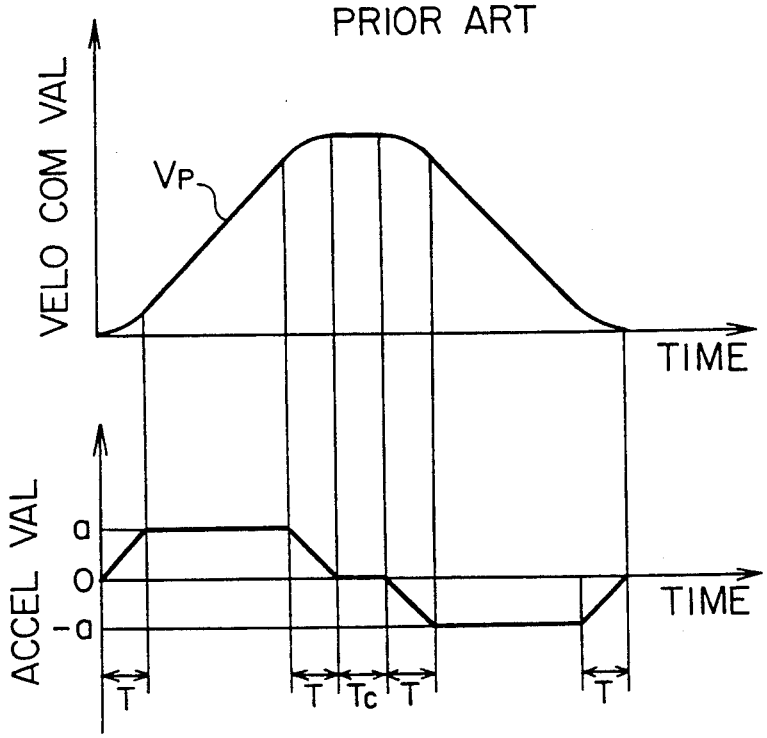
FIG. 7 PRIOR ART
FIG. 7 is a diagram of an acceleration curve for similarly explaining the prior-art method.

FIGS. 1 and 2 are flow charts each showing an embodiment of this invention, and FIG. 3 is a diagram of elevator deceleration curves corresponding to a deceleration part in the acceleration curve diagram of FIG. 7 including arrival time interval $T_a$ and arrival time interval $T_b$. In addition, a constructional view showing elevator equipment shall be omitted from illustration because of the similarity to FIG. 4. Further, since the movement of a cage and the generation of a velocity command are similar to those in the prior-art method, they shall not be repeatedly described.

As the first embodiment of this invention, FIG. 1 shows the flow chart for calculating the delay time $T_1$ of a control system. During the deceleration of a cage 6, the velocity signal of a tachometer generator 19 is applied through the third input converter 24 to a CPU 14. Here, the applied signal is differentiated to obtain a deceleration value, and such a value is stored in a RAM 17 every calculation cycle. During the stop of the cage 6, the deceleration values stored in the RAM 17 during the travel of this cage are analyzed, and discriminations are done so as to bring the delay time $T_1$ near to a theoretical value. More specifically, when the cage 6 is decided to be traveling at a step 30, whether it is under deceleration is determined at a step 31, and if not, no further processing is executed. If the cage 6 is under deceleration, a step 32 clears a delay time calculating mask flag in advance, and a step 33 differentiates the velocity signal applied from the tachometer generator 19 and stores the result in the RAM 17. On the other hand, when the cage 6 is decided to be at a stop at the step 30, whether the delay time calculating mask flag is set is determined at a step 34. If the flag is set, the delay time $T_1$ has already been calculated on the basis of the travel of the cage 6 before the stop thereof, and hence, no further processing is executed. In contrast, if the flag is not set, the delay time $T_1$ is calculated from the deceleration values stored in the RAM 17, by the following discriminative method: A step 35 discriminates if an arrival time interval $T_a$ for reaching the maximum deceleration value $-a$ is shorter than the theoretical value T as indicated by a waveform A in FIG. 3. If the time interval is shorter, the delay time $T_1$ needs to be lengthened so as to approach the value T, and hence, a predetermined value $\Delta t$ is added to the delay time $T_1$ generating a new value $T_1$ at a step 36. A step 37 is a processing step for preventing the delay time $T_1$ from becoming too great, and if the delay time $T_1$ exceeds its maximum value $T_{1max}$ which can be assumed, a step 38 sets a reference value as the delay time $T_1$. In contrast, if the arrival time $T_a$ is not shorter than the value T at the step 35, a step 39 discriminates if an arrival time $T_b$ for reaching the maximum deceleration value $-a$ is longer than the theoretical value T as indicated by a waveform B in FIG. 3. If the arrival time $T_b$ is longer, the delay time $T_1$ needs to be shortened so as to approach the theoretical value T, and hence, the predetermined value $\Delta t$ is subtracted from the delay time $T_1$ generating a new value $T_1$ at a step 40. A step 41 is a processing step for preventing the delay time $T_1$ from becoming too small, and if the delay time becomes minus, a step 42 sets a reference value as the delay time $T_1$. If the arrival time $T_b$ is not longer than the value T at the step 39, a step 43 discriminates if the deceleration value of the cage 6 exceeds an allowable value ($-a-\alpha$) as indicated by a waveform C in FIG. 3. If the deceleration exceeds the allowable value, the delay time $T_1$ needs to be shortened as in the processing of the step 39, and hence, the processing of the step 40 et seq. is executed. If all the conditions of the steps 35, 39 and 43 are satisfied, the delay time $T_1$ can be said to be the optimum value and is therefore left intact. Meanwhile, since the processing of the steps 35–43 may be executed only once during the stop of the cage, the delay time calculating mask flag is set at a step 44 in order to mask the processing of these steps 35–43. In this case, a corrective distance K differs depending upon the delay time $T_1$ and therefore needs to be changed every delay time. In this embodiment, an example of the discriminative reference for changing the delay time $T_1$ as at the step 36 or 40 is the processing of the step 35, 39 or 43. Since, however, the discrimination has heretofore been manually done, another discriminative reference may be added if any.

FIG. 2 is the flow chart for calculating the delay time, in the case of changing the delay time every traveling condition of a cage. In the velocity control for an elevator, the delay of a control system is delicately different, depending upon the traveling conditions of the cage such as ascent or descent, heavy load or light load, and high-speed travel or low-speed travel. It is therefore desirable to use separate delay times for the respective traveling conditions. Only the parts of the second embodiment differing from the first embodiment in FIG. 1 will be described below. During the travel of the cage 6, the traveling condition is recognized at a step 50 following the steps 30 –33. On the other hand, when it is decided by the step 34 during the stop of the cage 6 that the delay time calculating mask flag is not set, a step 51 discriminates the traveling condition of the travel before the stop, whereupon the optimum value of the delay time $T_1$ under the discriminated traveling condition is calculated. In this case, while the cage 6 is traveling, it is required to evaluate the corrective distance K from the delay time $T_1$ in accordance with the traveling condition and to use separate subtractive components $a \cdot T_1$ which are subtracted from the velocity command value $V_d$.

As described above in detail, according to this invention, in order to render the deceleration of a cage favorable, the delay time between the response of a control system and the actual movement of the cage responsive to a velocity command value from an electronic computer has its optimum value found while the velocity command signal is varied by the electronic computer, whereupon a velocity command value preceding the delay time is output from the electronic computer. Therefore, the invention brings forth the effect cf providing an elevator velocity control method which dispenses with adjustments for the riding quality of the cage and which ensures a good riding quality and a high floor arrival accuracy.

What is claimed is:

1. A method for determining optimum delay time between a velocity command signal for an elevator cage and actual movement of the cage responsive to the velocity command signal, said method comprising steps of:

(a) differentiating a velocity command signal to obtain a selected deceleration value;

(b) calculating a value representing an actual time interval needed for the elevator to reach the selected deceleration value;

(c) incrementing a delay time value between the velocity command signal and the actual movement of the cage by a predetermined incremental value when the actual time interval is shorter than a standard time interval;

(d) decrementing the delay time value by a predetermined incremental value when the calculated value representing the actual time interval exceeds a value representing a standard time interval;

(e) decrementing the delay time value by a predetermined incremental value when the calculated value representing the actual time interval is equal to the value representing the standard time interval and a measured deceleration value is greater than the selected deceleration value;

thereby generating a delay time value which represents the optimum delay time which when introduced into the velocity command signal will cause the elevator cage to travel smoothly and accurately to its intended destination.

2. A velocity control method for an elevator as defined in claim 1, wherein said delay time is calculated for each of traveling condition of said cage, said traveling conditions including an ascent operation or descent operation, a heavy load or light load, and a high-speed travel or low-speed travel.

3. A method of determining optimum delay time according to claim 1 further including the step of setting the delay time value equal to a predetermined reference value when the delay time value exceeds a predetermined maximum value.

4. A method of determining optimum delay time according to claim 1 further including the step of setting the delay time value equal to a predetermined reference value when the delay time value is less than zero.

5. A method of controlling velocity of an elevator cage through introducing a determined time delay into a velocity command signal, comprising the steps of:

(a) calculating a value representing an optimum time delay between a velocity command signal and actual movement of an elevator cage responsive to the velocity command signal based upon a comparison between values representing measured actual time intervals and standard time intervals;

(b) introducing the optimum time delay into the velocity command signal for controlling the response to the velocity command signal and causing the elevator cage to travel smoothly to its intended destination.

* * * * *